United States Patent [19]

Hori

[11] Patent Number: 4,877,343

[45] Date of Patent: Oct. 31, 1989

[54] SERIAL PRINTER HAVING MEANS FOR CONTROLLING PRINT HEAD IN RELATION TO CARRIAGE MOVEMENT

[75] Inventor: Masaaki Hori, Nagoya, Japan

[73] Assignee: Brother Kogyo Kabushiki Kaisha, Nagoya, Japan

[21] Appl. No.: 109,540

[22] Filed: Oct. 19, 1987

[30] Foreign Application Priority Data

Oct. 23, 1986 [JP] Japan ..... 61-252187

[51] Int. Cl.[4] ..... B41J 3/02

[52] U.S. Cl. ..... 400/121; 400/124; 400/320; 400/322

[58] Field of Search ..... 400/320, 322, 121, 124

[56] References Cited

U.S. PATENT DOCUMENTS

| | | | |
|---|---|---|---|
| 4,169,991 | 10/1979 | Ross | 400/322 X |
| 4,180,335 | 12/1979 | Yamada | 400/322 X |
| 4,185,930 | 1/1980 | Umeda et al. | 400/322 X |
| 4,203,678 | 5/1980 | Nordstrom et al. | 400/322 X |
| 4,213,714 | 7/1980 | Jones et al. | 400/124 |
| 4,232,975 | 11/1980 | Kane | 400/322 X |
| 4,405,245 | 9/1983 | Fukushima | 400/322 X |
| 4,415,286 | 11/1983 | Jennings | 400/121 X |
| 4,468,140 | 8/1984 | Harris | 400/322 X |
| 4,487,515 | 12/1984 | Harris | 400/121 |
| 4,652,159 | 3/1987 | Nagai | 400/322 |
| 4,669,897 | 6/1987 | Asakura et al. | 400/322 X |
| 4,683,818 | 8/1987 | Hewlett, Jr. | 400/322 X |

FOREIGN PATENT DOCUMENTS

| | | | |
|---|---|---|---|
| 0040313 | 11/1981 | European Pat. Off. . | |
| 0083694 | 7/1983 | European Pat. Off. . | |
| 0183095 | 6/1986 | European Pat. Off. . | |
| 52-27635 | 6/1977 | Japan . | |
| 0145477 | 11/1981 | Japan | 400/322 |
| 0135184 | 8/1982 | Japan | 400/322 |
| 0147373 | 8/1985 | Japan | 400/322 |
| 1514030 | 6/1978 | United Kingdom . | |
| 2077012 | 12/1981 | United Kingdom . | |
| 2106678 | 4/1983 | United Kingdom . | |
| 2127193 | 4/1984 | United Kingdom | 400/322 |

*Primary Examiner*—Ernest T. Wright, Jr.
*Attorney, Agent, or Firm*—Oliff & Berridge

[57] ABSTRACT

A serial printer including a print head, a carriage supporting the print head and moved by a drive motor along a line of printing, a pulse generating device for generating pulse signals corresponding to incremental distances of movement of the carriage, a time-data memory for storing time data representative of a time interval between a point of generation of each of the pulse signals, and a point at which the print head effects a printing operation, and a time-interval measuring device operable to measure the time interval according to the time data stored in the time-data memory. The time-interval measuring device generates a printing command to activate the print head upon termination of measurement of the time interval.

11 Claims, 5 Drawing Sheets

30
SOLENOID
60-1
60-2
60-3
60-4
60-n
PRINT WIRE
62-1
62-2
62-3
62-4
62-n
SOLENOID DRIVER
58
CHARACTER DATA MEMORY
56
HEAD CONTROLLER
54
CARRIAGE
20
TIME-DATA MEMORY
46
PRINT TIMER
LD
48
DC MOTOR
80
TABLE SELECTOR
52
PRINT TIMING CONTROLLER
44
MOTOR DRIVER
90
CHARACTER-WIDTH SELECTOR
50
SLIT DETECTOR
88
CARRIAGE CONTROLLER
92
$t_d$
$t$
$t_p$

SERIAL PRINTER HAVING MEANS FOR CONTROLLING PRINT HEAD IN RELATION TO CARRIAGE MOVEMENT

BACKGROUND OF THE INVENTION

The present invention relates generally to a serial printer wherein a print head supported by a carriage effects a printing operation while the print head is moved along a line of printing, and more particularly to a technique for improved accuracy of controlling the printing points or positions at which the print head is activated.

Means for controlling the printing actions of the print head of a serial printer are disclosed in Japanese Utility Model Application laid open for opposition purpose on June 23, 1977 under Publication No. 52-27635, and in U.S. Pat. No. 4,213,714. In a printer disclosed in the former document, the print head is controlled according to printing commands which are generated at a predetermined frequency, independently of an operation of a drive motor to move the carriage. In a printer disclosed in the latter document, the carriage drive motor has an encoder, and the printing actions of the print head are controlled according to output signals generated by the encoder.

In the printer of the laid-open Publication No. 52-27635, however, the operating or printing positions or points of the print head do not have a direct relation with the incremental position of the carriage. According to this arrangement, operating errors of a timer used and/or variations in signal processing time accumulate during repeated control cycles for the successive printing actions, whereby the print head tends to be activated when the carriage (i.e., the print head) is not located at the appropriate positions along the print line. Thus, the printer is likely to suffer from undesirable deviation of the actual printing positions from the nominal printing positions.

The printer disclosed in the above-identified U.S. Patent does not suffer from such a problem, but requires an expensive rotary encoder. Described more specifically, this printer uses a rotary encoder in the form of a disc which is rotated with a carriage drive motor. The encoder disc has a multiplicity of radially extending slits. As the disc is rotated, passage of the slits is detected by a transducer, which produces pulse signals corresponding to the detected slits. A printing command is applied to the print head, when the number of the produced pulse signals reaches a predetermined value. By changing this value, the width of each character to be printed can be varied in a plurality of steps. This arrangement therefore requires the slits of the disc to be arranged at an extremely small angular interval. In other words, the encoder disc must be formed with a very large number of slits, which inevitably pushes up the cost of manufacture.

SUMMARY OF THE INVENTION

The present invention was developed in the light of the aforementioned problems encountered in the prior art. It is accordingly an object of the present invention to provide a serial printer which may utilize a comparatively inexpensive rotary encoder or which eliminates a rotary encoder, thereby reducing the cost of the printer, while assuring reduced tendency of deviation of the actual printing positions from the nominal positions.

The above object may be achieved according to the principle of the present invention, which provides a serial printer comprising: (a) a print head; (b) a carriage supporting the print head and moved by a drive motor along a line of printing; (c) pulse generating means for generating pulse signals corresponding to incremental distances of movements of the carriage; (d) a time-data memory for storing time data representative of a time interval between a point of generation of each of the pulse signals, and a point at which the print head effects a printing operation; and (e) time-interval measuring means operable to measure the time interval according to the time data stored in the time-data memory, and generate a printing command to activate the print head upon termination of measurement of the time interval.

In the serial printer of the present invention constructed as described above, the point of generation of of each printing command applied to the print head is determined based on the point of generation of a corresponding pulse signal which is produced by the pulse generating means in precise timed relation with an incremental movement of the carriage. Thus, the instant serial printer is adapted to avoid the conventionally experienced deviation of the actual printing positions from the nominal positions, which arises from accumulative control inaccuracy due to operating error of a timer and/or variations in the signal processing time. The instant printer therefore provides an advantage of enhanced printing quality.

According to one feature of the invention, the drive motor consists of a stepping motor, and the printer further comprises an open-loop control circuit which includes a pulse generator for generating motor command pulses at a predetermined frequency to command the stepping motor to perform stepping actions. In this case, the command pulses serve as the pulse signals, whereby the pulse generating means consists of the pulse generator. This arrangement eliminates a closed-loop feedback control circuit which includes a rotary encoder to detect the operating phase of the carriage drive motor. Consequently, the cost of the serial printer can be accordingly reduced. Yet, the printing points of the print head can be precisely controlled.

According to another feature of the invention, the printer further comprises a rotating member which has a multiplicity of mutually equiangularly spaced-apart portions to be sensed and which is rotated in synchronization with the drive motor, and the printer further comprises a detector for sensing passage of the spaced-apart portions to provide corresponding output signals. In this case, the output signals serving as the pulse signals, whereby the pulse generating means consists of the rotating member and the detector. While the present arrangement requires a closed-loop control circuit including the rotating member and detector, the number of the spaced-apart portions such as slits of the rotating member can be considerably reduced, since the number of the required spaced-apart portions per each character to be printed is equal to or smaller than the number of printing points or actions necessary to print the character. Therefore, the rotating member is available at a reduced cost.

According to a further feature of the invention, the printer further comprises selector means for changing a width of each character printed by the print head, and wherein the time-data memory stores a plurality of time-data tables which include respective different sets of timing pattern data serving as the time data. Each set of timing pattern data are indicative of successive printing points, and the desired one of the time-data tables is selected by the selector means.

According to a still further feature of the invention, the time-interval measuring means generates the printing command, in response to each of the pulse signals generated by the pulse generating means. The time interval is constant for all of the pulse signals.

According to a yet further feature of the invention, the time-interval measuring means generates a plurality of printing commands in response to each of the pulse signals generated by the pulse generating means.

In one form of the above feature of the invention, the time-interval measuring means measures the time interval for a first one of the printing commands, based on the point of generation of each pulse signal, and measures the time interval for each of subsequent commands of the printing commands, based on a point of generation of one of the printing commands which immediately precedes each subsequent command.

In another form of the above feature of the invention, the time-interval measuring means generates a set of successive first, second, third and fourth printing commands, in response to a set of successive first, second and third pulse signals generated by the pulse generating means, such that a time duration between points of generation of the first pulse signal and the first printing command is equal to a time duration between points of generation of the third pulse signal and the fourth printing command, and such that the points of generation of the first, second, third and fourth printing commands define three equally divided time spans between the points of generation of the first and fourth printing commands.

In accordance with still another feature of the invention, the print head has a plurality of printing elements which are selectively activated to print a character in a matrix of dots which include a plurality of columns. In this case, the print head is responsive to the printing command, for selectively activating the printing elements, so as to perform the printing operation corresponding to one of the plurality of columns of the matrix of dots.

While the principle of the present invention is effectively applicable to a serial printer having a dot-matrix print head as indicated above, the same principle is also applicable to a serial printer having a print head which uses a type wheel or ball having formed type fonts. In this case, each printing command corresponds to each character to be printed.

According to another aspect of the present invention, there is provided a serial printer comprising: (a) a platen for supporting a recording medium; (b) a carriage movable in a direction parallel to the platen; (c) a print head supported by the carriage and disposed in facing relation with the platen; (d) a drive motor for moving the carriage; (e) pulse generating means for generating pulse signals corresponding to incremental distances of movements of the carriage; (f) a time-data memory for storing time data representative of a time interval between a point of generation of each of the pulse signals, and a point at which the print head effects a printing operation; (g) time-interval measuring means operable to measure the time interval according to the time data stored in the time-data memory, and generate a printing command to activate the print head upon termination of measurement of the time interval; (h) a character data memory for storing character data representative of characters to be printed by the print head; and (i) a print-head control circuit operable in response to the printing command, to retrieve the character data from the character data memory and commanding the print head to selectively activate a plurality of printing elements thereof.

According to one feature of the above aspect of the invention, the printer further comprises selector means for changing a width of each character printed by the print head, and the time-data memory stores a plurality of time-data tables which include respective different sets of timing pattern data serving as the time data. Each set of timing pattern data is indicative of successive printing points. The time-interval measuring means includes a timer for measuring the time interval, and a print timing controller connected to the timer, the time-data memory and the pulse generating means. The print timing controller is responsive to the pulse signals, to command the time-data memory to apply to the timer one of the different sets of timing pattern data selected by the selector means, so that the timer measures the time intervals defined by the one set of timing pattern data.

In one form of the above feature of the invention, each of the different sets of timing pattern data stored in the time-data memory consists of a plurality of time-interval data indicative of the time intervals to be measured by the timer. The time-data memory sequentially supplies the plurality of time-interval data to the timer, according to an incrementally changing state of a timing pointer provided in the print timing controller. In this arrangement, each of the plurality of time-data tables stored in the time-data memory may further include flag data according to which a maximum value of the timing pointer to be incremented by the print timing controller is determined. The timing pointer is reset to an initial state after the maximum value is reached.

BRIEF DESCRIPTION OF THE DRAWINGS

The foregoing and optional objects, features and advantages of the present invention will become more apparent by reading the following detailed description of presently preferred embodiments of the invention, when considered in connection with the accompanying drawings, in which.

DETAILED DESCRIPTION OF THE PREFERRED EMBODIMENTS

Figure 1:
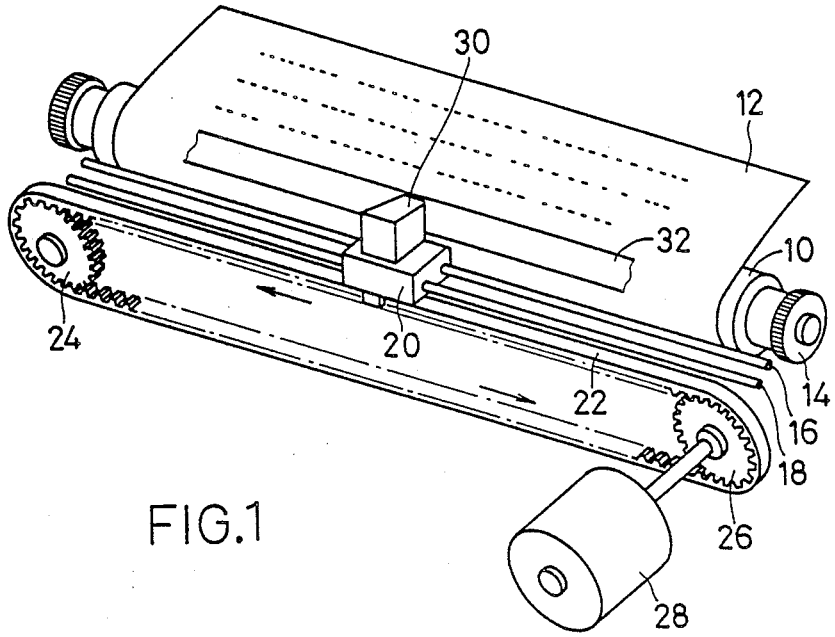
FIG. 1 is a fragmentary perspective view of a printing mechanism of a serial printer constructed according to one embodiment of the present invention.
Figure 2:
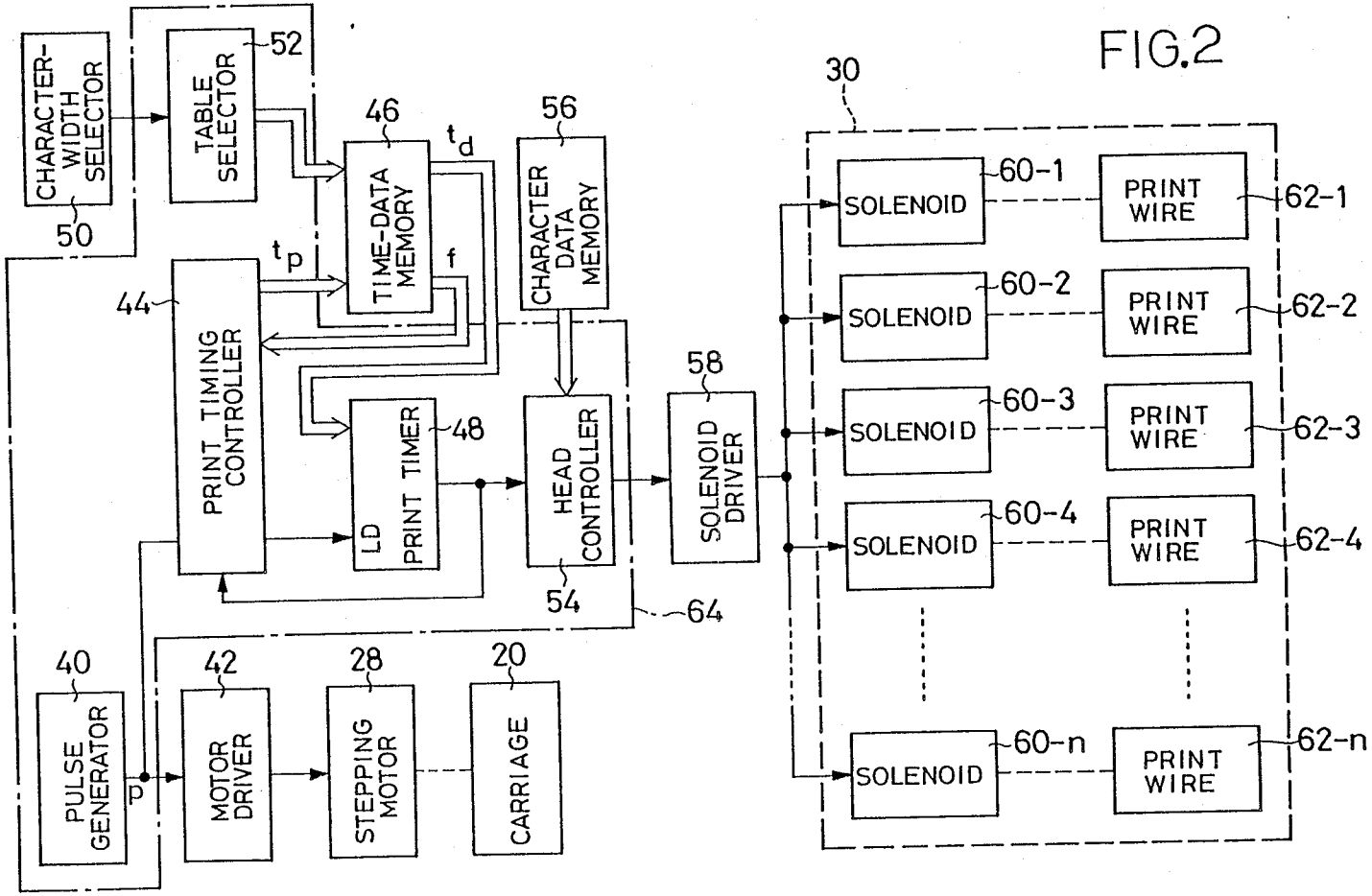
FIG. 2 is a schematic block diagram showing a portion of a control system of the serial printer of FIG. 1 which is closely associated with the concept of the present invention.

Referring first to FIG. 1, there is shown a principal portion of a printing mechanism of a dot-matrix type serial printer. In the figure, reference numeral 10 designates a platen. This platen 10 is rotatably supported and is adapted to support a recording paper 12. The platen 10 is formed with a gear 14 and rotated via the gear 14, so as to feed the paper 12. Guide rods 16, 18 are disposed parallel to the platen 10, in order to slidably support a carriage 20 so that the carriage 20 is movable in a direction parallel to the platen 10. The carriage 20 is operatively coupled to a carriage drive stepping motor 28, via a timing belt 22 and timing gears 24, 26. On the carriage 20, there is provided a print head 30 which has a plurality of print wires 62-1 through 62-n, as shown in FIG. 2. Each of the print wires 62-1 through 62-n is adapted to be moved between an advanced printing position and a retracted rest position, due to energization and de-energization of respective solenoids 60-1 through 60-n also shown in FIG. 2. Upon energization of the selected solenoids 60-1 through 60-n, the corresponding print wires 62-1 through 62-n brought into their advanced printing positions are impacted against the paper 12 via a print ribbon 32, whereby printing is effected in a matrix of dots.

The carriage drive stepping motor 28 and the print head 30 are controlled by a control system illustrated in FIG. 2. In the figure, reference numeral 40 indicates a pulse generator adapted to generate motor command pulses p at a predetermined frequency, which command pulses p are applied to a motor driver 42. Upon reception of the motor command pulses p, the motor driver 42 supplies an electric current to energize the stepping motor 28, whereby the stepping motor 28 is activated in a stepping manner, as well known in the art. Accordingly, the carriage 20 is fed at a suitable rate.

The motor command pulses p generated by the pulse generator 40 are also used as pulse signals which are applied to a print timing controller 44. This controller 44 is connected to a time-data memory 46 and a print timer 48. As described later, the time-data memory 46 stores two time-data tables which include respective different sets of timing pattern data. One of the time-data tables is selected according to an output signal from a table selector 52, which receives a signal from a character-width selector 50. In the present embodiment, this selector 50 is an operator-controlled selector switch operated to change the width of the characters to be printed. The time-data memory 46 is responsive to an incrementally changing state of a timing pointer $t_p$ provided in the print timing controller 44. More specifically, the time-data memory 46 sequentially supplies the print time 48 with time-interval data $t_d$ corresponding to the current state or value of the timing pointer $t_p$. Further, the time-data memory 46 applies flag data f to the print timing controller 44. Each time the print timer 48 terminates the measurement of each time interval represented by each time-interval data $t_d$ supplied from the time-data memory 46, the timer 48 applies a printing command to a head controller 54, which in turn retrieves from a character data memory 56 a portion of a set of character data representative of a character. This portion of the character data indicates dots to be formed in an appropriate column (vertical row) of a dot matrix of the character. The retrieved portion of the character data is then applied to a solenoid driver 58, which in turn energizes the appropriate solenoids 60-1 through 60-n of the print head 30, whereby the corresponding print wires 62-1 through 62-n are moved to the advanced printing position, to form dots in the appropriate column of the dot-matrix.

In the interest of brevity and simplification, here are provided no detailed descriptions of the operations of the motor driver 42 stepping motor 28, character data memory 56, head controller 54, solenoid driver 58 and print head 30, all of which are operated in the same manner as those of a conventional serial printer, as well known in the art. There will be described the operation to control the timing at which the head controller 54 is commanded to retrieve the character data from the character data memory 56 and supplies the retrieved data to the solenoid driver 58.

Figure 3:
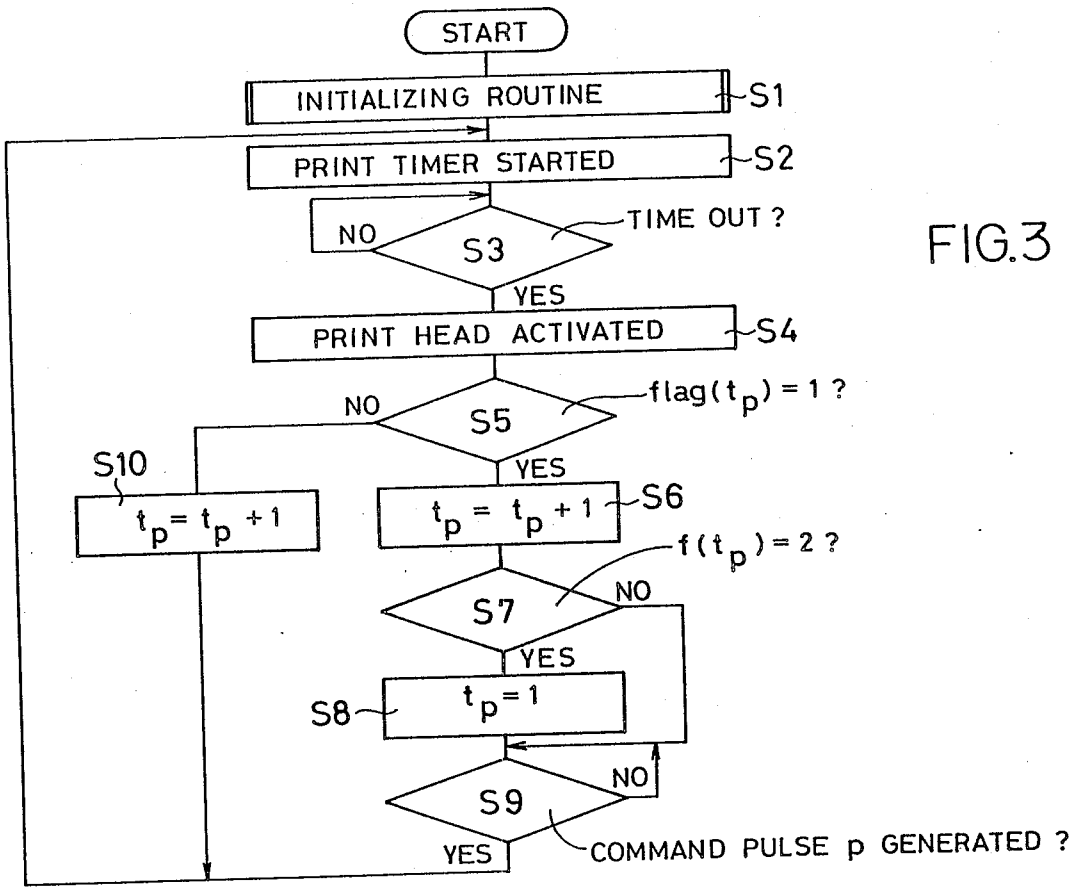
FIG. 3 is a flow chart for explaining a control program for controlling printing points of time in the serial printer of FIG. 1.
Figure 4:
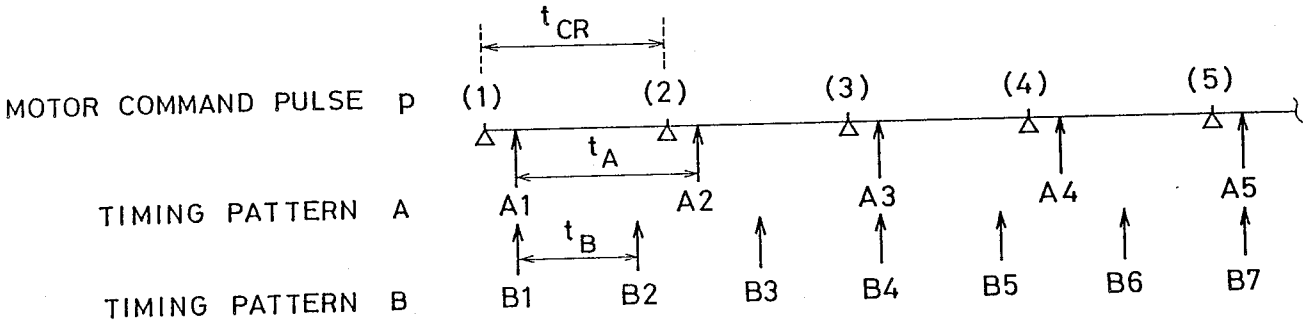
FIG. 4 is a timing chart illustrating two different timing patterns in relation to carriage motor command pulses.

The flow of the control operation is illustrated in the flow chart of FIG. 3, and the printing points (moments at which the print wires 62-1 through 62-n are activated) of the print head 30 are indicated in the timing chart of FIG. 4, in relation to the motor command pulses p for the stepping motor 28. In the timing chart, (1), (2), (3), (4) and (5) indicate the points or moments at which the motor command pulses p are generated. The stepping motor 28 to drive the carriage 20 is controlled based on these command pulses p. In the same chart, Al, A2, A3, A4 and A5 indicate the points or moments at which the printing commands are generated from the print timer 48 to activate the print head 30, where a timing pattern data "A" defined in one of the two time-data tables stored in the time-data memory 46 is selected. The timing pattern data "A" is adapted to print each character with a comparatively large width. Similarly, B1 through B7 indicate the points of generation of the printing commands, where a timing pattern data "B" of the other time-data table for comparatively small character width is selected. A reference legend $t_{CR}$ represents a period of the motor command pulse p, while reference legends $t_A$ and $t_B$ represent time durations between adjacent or successive printing actions of the print head 30, when the timing pattern data "A" and "B" are selected, respectively. The two time-data tables stored in the time-data memory 46, which include the above-indicated timing pattern data "A" and "B", are shown in Tables 1 and 2 below.

TABLE 1

| $t_p$ | $t_d$ | f |
|---|---|---|
| 1 | [A1–(1)] | 1 |
| 2 | 0 | 2 |

TABLE 2

| $t_p$ | $t_d$ | f |
|---|---|---|
| 1 | [B1–(1)] | 0 |
| 2 | [B2–B1] | 1 |
| 3 | [B3–(2)] | 1 |
| 4 | 0 | 2 |

In Tables 1 and 2, the time-interval data [Al–(1)][-B1–(2–B1], [B3–(2)], etc. represent time intervals or durations between adjacent points of events, e.g., between the moments of generation of two successive printing commands. More particularly stated, the time-interval data [A1 –(1)], [B1 –(1)] and [B3 –(2)] represent time intervals between the point of generation of a motor command pulse p, and the point of generation of a printing command to activate the print head 30 to print the corresponding column of a dot-matrix of a character. On the other hand, the time-interval data [B2–B1] represents a time interval between the points of generation of the first and second printing commands. However, since the point of generation of the first printing command corresponding to the first column of the matrix is determined based on the point of generation of the motor command pulse p, the time-interval data [B2–B1] may be considered as time-interval data representative of a time interval between the point of generation of the motor command pulse p, and the point of generation of the second printing command.

Upon application of power to the present serial printer, an initializing routine is executed in step S1, in which various pointers, counters and other elements of the control system are set or reset to initial values. In addition, the carriage 20 is moved to its preset left-margin position, and the timing pointer $t_p$ in the print timing controller 44 is set to "1".

Subsequently, the operation of the stepping motor 28 for the carriage 20 according to the motor command pulses p from the pulse generator 40 is started. At the same time, the operation of the print timing controller 44 to control the print head 30 is initiated.

Assuming that the character-width selector switch 50 is set in the position for the comparatively large character width, the table selector 52 selects one of the two time-data tables stored in the time-data memory 46, which is indicated in Table 1 and which includes the timing pattern data "A". In this case, the print head 30 is activated so as to print one column of a dot matrix of each character, in response to one incremental stepping operation of the stepping motor 28, i.e., in response to one motor pulse command p generated from the pulse generator 40. Described more specifically, each time the motor pulse command p is generated, the print timing controller 44 commands the time-data memory 46 to load the print timer 48 with the time-interval data [Al–(1)], whereby the timer 48 commences the measurement of the thus set time interval represented by this data, in step S2. Upon termination of measurement of the set time interval, the print timer 48 applies a printing command to the head controller 54. Namely, when an affirmative decision (YES) is obtained in step S3, the following step S4 is implemented to activate the print head 30.

In the following step S5, the print timing controller 44 determines whether the flag data f currently supplied from the time-data memory 46 is equal to "1" or not. As is apparent from Table 1, the flag data f is "1" when the current state of the timing pointer $t_p$ is "1". Consequently, an affirmative decision (YES) is obtained in step S5, and the control goes to step S6 in which the timing pointer $t_p$ is incremented to "2". Accordingly, an affirmative decision (YES) is obtained in step S7, and the control goes to step S8 in which the timing pointer $t_p$ is reset to the initial value "1". Step S8 is followed by step S9 to check if a motor command pulse p has been generated. When the second motor command pulse p is generated, an affirmative decision (YES) is obtained, and the control returns to step S2.

Thus, each time the time interval represented by the time-interval data [A1–(1)] elapses after the generation of a motor command pulse p from the pulse generator 40, a printing command is supplied from the print timer 48 to the head controller 54. Based on this printing command, the print head 30 is activated so as to print a column of the dot matrix of a character. Since the point at which each column of the dot matrix is printed is determined based on the point of time at which the corresponding motor command pulse p is generated to activate the stepping motor 28 for the carriage 20, there arises no deviation of the actual printing points or positions from the nominal positions, due to otherwise possible accumulative error in the data processing cycles for multiple successive print columns along the line of printing. Therefore, the printing quality is enhanced.

There will next be described the operation where the character-width selector 50 is set in the position for the comparatively small character width. In this case, each printing action of the print head 30 occurs in a time span shorter than that of a stepping action of the stepping motor 28.

When the print timing controller 44 receives a motor pulse command p from the pulse generator 40, the controller 44 commands the time-data memory 46 to load the print timer 48 with the first time-interval data [B1–(1)] of the timing pattern data "B" of the time-data table of Table 2, which time-interval data corresponds to the value "1" of the timing pointer $t_p$. In response to this first time-interval data, the print timer 48 starts measuring the time interval represented by the data, in step S2. When the timer 48 times out (step S3), the timer 48 applies a first printing command to the head controller 54, whereby the first column of a print line is printed (step S4). Thus, the point of time at which the first column is printed is directly determined by the moment at which the first motor command pulse p is generated by the pulse generator 40.

Then, the print timing controller 44 determines in step S5 whether the flag data f currently supplied from the time-data memory 46 is "1" or not. Since the current value of the timing pointer $t_p$ is "1", the flag data f is equal to "0", as is apparent from Table 2. As a result, a negative decision (NO) is obtained in step S5, and the control goes to step S10 in which the timing pointer $t_p$ in the controller 44 is incremented to "2". Then, the control goes to step S2.

In the instant execution of step S2, the print timer 48 is loaded with the second time-interval data [B2–B1] which corresponds to the value "2" of the timing pointer $t_p$. Upon termination of measurement of the thus set time interval (S3), the timer 48 applies a second printing command to the head controller 54 to activate the print head 30 (S4). That is, the second column of the print line is printed when the print timer 48 terminates the measurement of the time interval represented by the second time-interval data. Since the moment at which the timer 48 starts measuring the second time interval is determined by the point of time at which the first motor pulse command p is generated from the pulse generator 40, it can be said that the print point of the second column is indirectly determined by the point of generation of the first motor pulse command p.

Subsequently in step S5, the print timing controller 44 determines whether the flag data f is equal to "1". Since the timing pointer $t_p$ is currently "2", the flag data f is "1" as indicated in Table 2, whereby an affirmative decision (YES) is obtained in step S5. Consequently, the timing pointer $t_p$ is incremented to "3" in the following step S6, and the control goes to step S7 to determine whether the flag data f is equal to "2". At this time, the flag data f is "1" as indicated in Table 2, the control skips step S8 and goes to step S9 in which the print timing controller 44 awaits generation of a second motor pulse command p. When the second motor pulse command p is generated, the control returns to step S2, in which the print timer 48 is loaded with the next time-interval data.

At this point of time, the timing pointer $t_p$ is "3", and the time-interval data to be loaded to the timer 48 is [B3-(2)]. Upon termination of the corresponding time interval, the timer 48 applies a third printing command to the head controller 54, whereby the third column of the print line is printed by the print head 30. Thus, the printing point of the third column is directly determined based on the point of generation of the second motor command pulse p from the pulse generator 40.

Then, the control goes to step S5 to determine whether the flag data f is "1" or not. At this time, the timing pointer $t_p$ is "3", and therefore the flag data f is "1", whereby an affirmative decision (YES) is obtained in step S5. As a result, step S6 is implemented to increment the timing pointer $t_p$ to "4", whereby the flag data f supplied becomes "2". Consequently, an affirmative decision (YES) is obtained in step S7, and step S8 is executed to reset the timing pointer $t_p$ to its initial value "1". Then, the controller 44 awaits the third motor command pulse p in step S9.

Upon generation of the third motor command pulse p, step S2 is again executed to load the print timer 48. In this instance, the time-interval data loaded to the timer 48 is [B1-(1)], i.e., the first time-interval data of the timing pattern data "B". Thereafter, the same control cycles as described above will be repeated. Namely, a relation between the printing point of the fourth column indicated at B4 in FIG. 4, and the point of generation of the third motor command pulse p indicated at (3), is identical with a relation between the printing point of the first column indicated at B1 and the point of generation of the first motor command pulse p indicated at (1).

It follows from the foregoing description that the instant serial printer is adapted such that each printing point at which the print head 30 effects a printing action to print a column of a print line is determined based upon the moment at which the last motor command pulse p is generated prior to that printing action, irrespective of whether the print head 30 effects one printing action or two or more printing actions within a time duration between the points of generation of two successive motor pulse commands p.

In the present embodiment, the pulse generator 40 serves as pulse generating means for generating pulse signals which correspond to incremental movements of the carriage 20, and upon which the points of generation of individual printing commands are determined. Further, the print timing controller 44 and the print timer 48 cooperate with each other to constitute time-interval measuring means for measuring a time interval between a point of generation of each of the pulse signals from the pulse generating means, and a point at which the print head 30 effects a printing action.

Further, the present serial printer using the stepping motor 28 for driving the carriage 20 does not use a closed-loop feedback system for controlling the carriage drive motor 28. Namely, the stepping motor 28 is controlled by means of an open-loop control circuit which includes the motor driver 42 and the pulse generator 40.

It is noted that a microcomputer 64 may be substituted for a portion of the control system indicated in one-dot chain line in FIG. 2, which includes the pulse generator 40, print timing controller 44, print timer 48, table selector 52 and head controller 54.

In the case where the print head 30 is required to print two or more columns of a print line during a time span defined by two successive motor pulse commands p, it is possible to use two or more timers corresponding to the above print columns. In this case, a printing command is generated when each of the timers times out, and each of the time-interval data stored in the time-data memory 46 represents a time interval between the point of generation of each motor command pulse p, and the printing point of the corresponding column.

Following the above concept, it can be considered that the single print timer 48 used in the embodiment discussed above is adapted to measure a time interval consisting of the two distinct time intervals represented by the two sets of time-interval data [B1-(1)] and [B2-B1]B1], in order to determine the printing point of the second column, for example. According to this concept, the printing point of the second column is also directly determined based on the point of generation of the last motor command pulse p. That is, it can be said that the combination of the two time-interval data [B1-(1)]and [B2-B1] constitutes a single set of time-interval data representative of a time duration from the point of generation of the first motor command pulse p, to the point at which the second column is to be printed.

It is also possible that the control routine used in the embodiment discussed above can be provided as an interruption routine to be executed in a main control routine of the printer.

Figure 5:
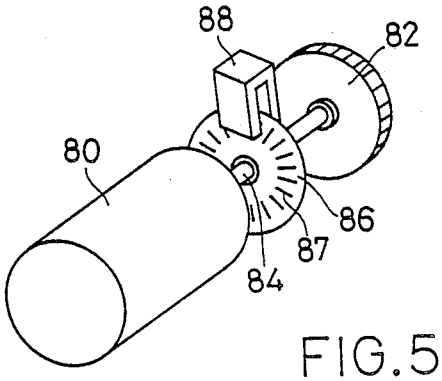
FIG. 5 is a perspective view of a carriage drive motor and components disposed adjacent to the motor, used in another embodiment of the invention.
Figure 6:
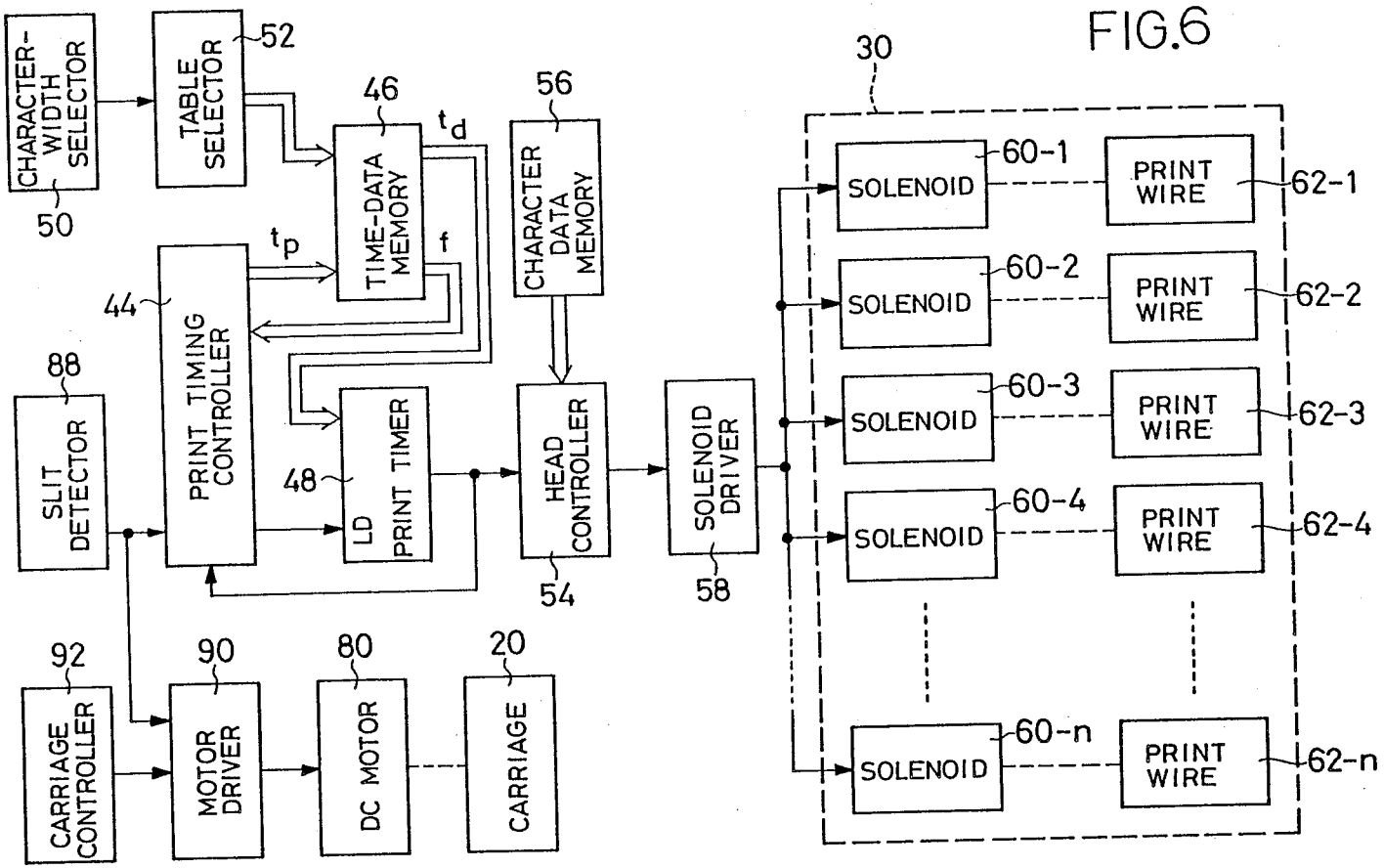
FIG. 6 is a schematic block diagram of a portion of a control system of the embodiment of FIG. 5, corresponding to that of FIG. 2.

Referring next to FIGS. 5 and 6, there is shown a modified embodiment of the invention. In FIG. 5, reference numeral 80 designates a DC motor adapted to drive the carriage 20 via a timing gear 82. The DC motor 80 is provided with a encoder disc 86 secured to an output shaft 84 thereof. The encoder disc 86 has a multiplicity of radially extending slits 87 which are equiangularly spaced apart from each other in the circumferential direction. These slits 87 serve as mutually spaced-apart portions to be sensed by a slit detector 88 disposed adjacent to the disc 86. The detector 88 generates output signals when the detector 88 senses passage of the slits 87. The output signals are fed to a motor driver 90 shown in FIG. 6. The motor driver 90 is adapted to control the DC motor 80 such that the actual operating amount of the motor 80 represented by the output signals from the detector 88 coincides with a commanded value represented by input command signals from a carriage controller 92. That is, the DC motor 80 as a servo motor is controlled by means of a closed-loop feedback circuit which includes the detector 88, motor driver 90 and carriage controller 92.

The output pulse signals generated from the slit detector 88 are applied to the print timing controller 44, as in the preceding embodiment. No further description with respect to these output pulse signals is deemed necessary, since the signals serve the same function as the motor pulse commands p described in the connection with the preceding embodiment. In the present modified embodiment, the number of the slits 87 provided on the encoder disc 86 may be equal to or smaller than the number of columns of a dot matrix pattern employed on the printer. This means that the encoder disc 86 requires a considerably reduced number of slits 87, as compared with the encoder disc used in the printer disclosed in the previously identified U.S. Pat. No. 4,213,714, wherein the number (66 or 44) of slits provided on the encoder disc is six or four times the number (11) of the dot matrix columns. Accordingly, the cost of manufacture of the encoder disc 87 is comparatively low.

While the present invention has been described in its presently preferred embodiments, it is to be understood that the invention is not limited to the precise details of the illustrated embodiments, but the invention may be embodied with various changes, modifications and improvements, which may occur to those skilled in the art.

What is claimed is:

1. A serial printer comprising:

a print head;

a carriage supporting said print head and moved by a drive motor along a line of printing;

a pulse generator for generating pulse signals corresponding to incremental distances of movements of said carriage;

a time-data memory for storing time data representative of a time interval between a point of generation of each of said pulse signals, and a point at which said print head effects a printing operation; and time-interval measuring means operable to measure said time interval according to said time data stored in said time-data memory, and generate a printing command to activate said print head for effecting said printing operation upon termination of measurement of said time interval.

2. A serial printer according to claim 1, further comprising selector means for changing a width of each character printed by said print head, and wherein said time-data memory stores a plurality of time-data tables which include respective different sets of timing pattern data serving as said time data, each set being indicative of successive printing points, said plurality of time-data tables being selected by said selector means.

3. A serial printer according to claim 1, wherein said time-interval measuring means generates said printing command in response to each of said pulse signals generated by said pulse generator, said time interval being constant for all of said pulse signals.

4. A serial printer according to claim 1, wherein said time-interval measuring means generates a plurality of printing commands in response to at least one of said pulse signals generated by said pulse generator.

5. A serial printer according to claim 4, wherein said time-interval measuring means measures said time interval for a first one of said printing commands, based on said point of generation of said pulse signals each, and measures said time interval for each of subsequent commands of said printing commands, based on a point of generation of one of said printing commands which immediately precedes each said subsequent command.

6. A serial printer according to claim 4, wherein said time-interval measuring means generates a set of successive first, second, third and fourth printing commands, in response to a set of successive first, second and third pulse signals generated by said pulse generator, such that a time duration between points of generation of said first pulse signals and said first printing command is equal to a time duration between points of generation of said third pulse signals and said fourth printing command, and such that the points of generation of said first, second, third and fourth printing commands define three equally divided time spans between the points of generation of said first and fourth printing commands.

7. A serial printer according to claim 1, wherein said print head has a plurality of printing elements which are selectively activated to print a character in a matrix of dots which include a plurality of columns, said print head being responsive to said printing command, for selectively activating said printing elements, so as to perform said printing operation corresponding to one of said plurality of columns of said matrix of dots.

8. A serial printer according to claim 1, wherein said time-data memory stores a time-data table which includes a set of timing pattern data comprising a plurality of time-interval data representative of successive time intervals between a point of generation of said pulse signals, and printing points at which said print head effects printing operations, and wherein said time-interval measuring means includes a timer for measuring said time intervals, and a print timing controller which is connected to said timer and which has a timing pointer whose state incrementally changes, said print timing controller being responsive to said pulse signals, to command said time-data memory to sequentially apply to said timer said plurality of time-interval data, according to the incrementally changing state of said timing pointer of said print timing controller, so that said timer measures the time intervals defined by said set of timing pattern data.

9. A serial printer comprising:

a platen for supporting a recording medium;

a carriage movable in a direction parallel to said platen;

a print head supported by said carriage and disposed in facing relation with said platen;

a drive motor for moving said carriage;

pulse generating means for generating pulse signals corresponding to incremental distances of movements of said carriage;

a time-data memory for storing a time-data table which includes a set of timing pattern data comprising a plurality of time-interval data representative of successive time intervals between a point of generation of each of said pulse signals, and printing points at which said print head effects printing operations;

time-interval measuring means operable to measure said time intervals according to said time-data table stored in said time-data memory, and generate printing commands to activate said print head for performing said printing operations upon termination of measurement of said time intervals;

a character data memory for storing character data representative of characters to be printed by said print head; and a print head control circuit operable in response to said printing command, to retrieve said character data from said character data memory and command said print head to selectively activate a plurality of printing elements thereof.

10. A serial printer according to claim 9, further comprising selector means for changing a width of each character printed by said print head, and wherein said time-data memory stores a plurality of time-data tables which include respective different sets of timing pattern data, each set being indicative of successive printing points, said time-interval measuring means including a timer for measuring said time interval, and a print timer controller connected to said timer, said time-data memory and said pulse generating means, said print timing controller being responsive to said pulse signals, to command said time-data memory to apply to said timer one of said different sets of timing pattern data selected by said selector means, so that said timer measures the time intervals defined by said one set of timing pattern data.

11. A serial printer according to claim 9, wherein said time-data table stored in said time-data memory further includes flag data according to which a maximum value of a timing pointer to be incremented by a print timing controller is determined, said timing pointer being reset to an initial state after said maximum value is reached.

* * * * *